United States Patent [19]

Dyett et al.

[11] 4,438,774

[45] Mar. 27, 1984

[54] CIGARETTE CONVEYING DRUMS

[75] Inventors: Derek H. Dyett; Rex Harvey, both of High Wycombe, England

[73] Assignee: Molins Limited, London, England

[21] Appl. No.: 328,619

[22] Filed: Dec. 8, 1981

[30] Foreign Application Priority Data

Dec. 18, 1980 [GB] United Kingdom ..... 8040525

[51] Int. Cl.[3] ..... A24C 5/32; A24C 5/35

[52] U.S. Cl. ..... 131/282; 131/283; 198/683

[58] Field of Search ..... 131/94, 95, 282, 283, 131/71, 72, 83; 198/689

[56] References Cited

U.S. PATENT DOCUMENTS

| | | | |
|---|---|---|---|
| 3,665,930 | 5/1972 | Giatti | 131/94 |
| 3,715,056 | 2/1973 | Preston | 198/689 |
| 4,055,192 | 10/1977 | Berlin et al. | 131/110 |

FOREIGN PATENT DOCUMENTS

| | | | |
|---|---|---|---|
| 655478 | 1/1963 | Canada | 131/94 |
| 728467 | 2/1966 | Canada | 131/94 |
| 36010 | 6/1968 | Fed. Rep. of Germany | 131/94 |
| 1088176 | 10/1967 | United Kingdom | 131/94 |

*Primary Examiner*—Vincent Millin
*Assistant Examiner*—Harry J. Macey
*Attorney, Agent, or Firm*—Antonelli, Terry & Wands

[57] ABSTRACT

Apparatus for conveying cigarettes by means of one or more fluted drums has a frame including spaced front and back walls defining between them a suction manifold; a fluted drum in front of the frame; a tubular drum-carrying member which extends through an opening in the front wall of the frame, engages and seals in or around an aperture in the rear wall of the frame, and has a flange by which it is secured to the front wall of the frame, the drum being rotatable around the tubular member; and a drive shaft which extends axially through the tubular member, is secured to the front end of the drum, is supported by bearings carried by the tubular member, and carries at its rear end behind the rear wall of the frame a gear or other means by which it is driven; suction being transmitted to ports in the flutes of the drum from the manifold via a passage contained within the thickness of the wall of the tubular member in the region where it extends through the front wall of the frame.

8 Claims, 1 Drawing Figure

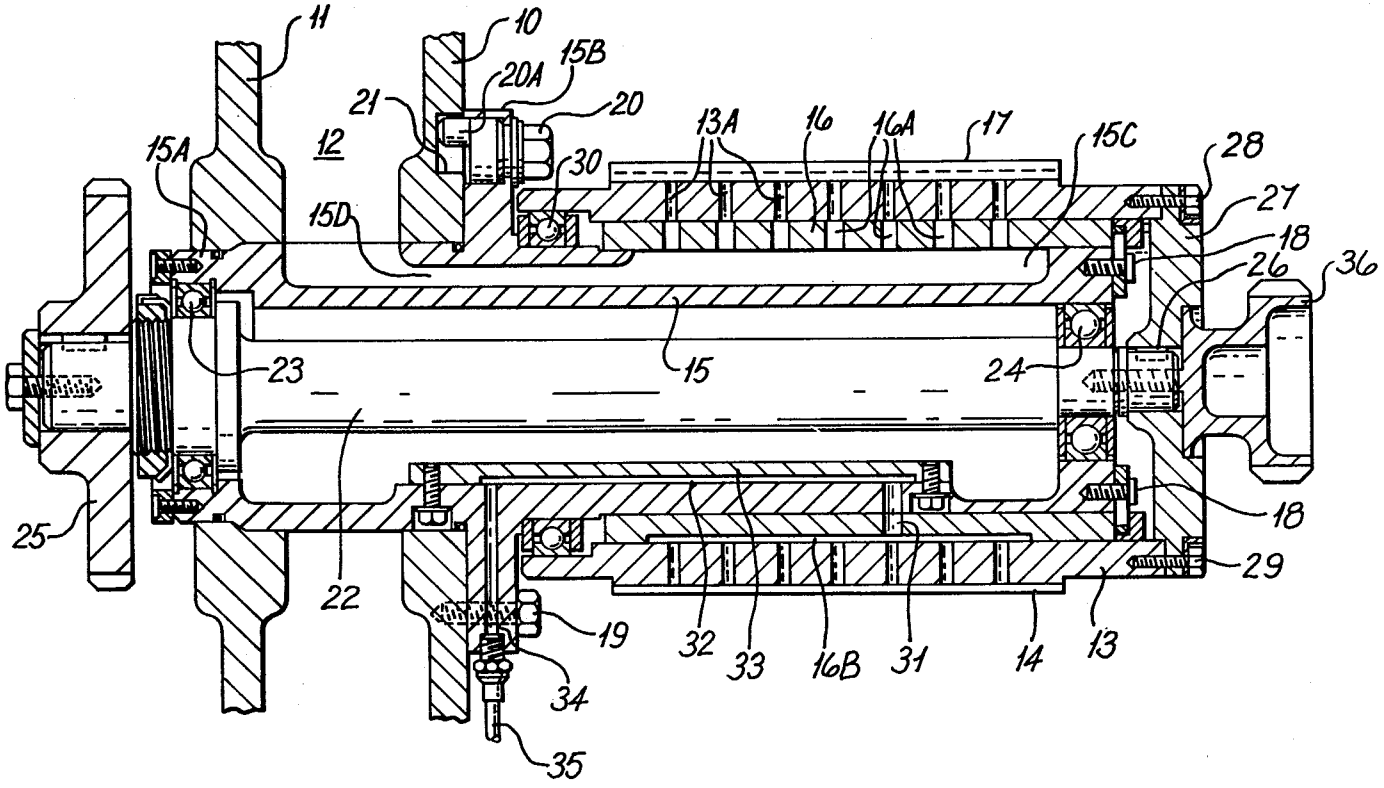
36
28
27
18
26
18
29
15C
13
24
14
17
16A
31
16
16B
13A
33
15
32
20
19
15B
30
34
35
10
20A
21
12
15D
22
11
23
15A
25

CIGARETTE CONVEYING DRUMS

This invention is concerned with apparatus for conveying cigarettes and similar rod-like articles by means of fluted drums arranged to carry the rods sideways in the flutes of the drums. This applies particularly to filter attachment machines.

Although the invention is applicable to the conveyance of rod-like articles other than cigarettes (for example filter rods) it will, for convenience, be described only in terms of cigarettes.

According to this invention, apparatus for conveying cigarettes by means of one or more fluted drums comprises a frame including spaced front and back walls defining between them a suction manifold; a fluted drum in front of the frame; a tubular drum-carrying member which extends through an opening in the front wall of the frame, engages and seals in or around an aperture in the rear wall of the frame, and has a flange by which it is secured to the front wall of the frame, the drum being rotatable around the tubular member; and a drive shaft which extends axially through the tubular member, is secured to the front end of the drum, is supported by bearings carried by the tubular member, and carries at its rear end (behind the rear wall of the frame) a gear or other means by which it is driven; suction being transmitted to ports in the flutes of the drum from the manifold via a passage contained within the thickness of the wall of the tubular member in the region where it extends through the front wall of the frame.

Amongst other advantages, this invention enables the suction passages to be isolated from parts (bearings and gears) which require lubrication, thus avoiding contamination of the suction air by lubricant.

The tubular member preferably includes or carries around it (within the drum) a sleeve valve through which suction is transmitted to the ports in the flutes of the drum, the timing of the application of suction being adjustable by adjusting the angular position of the tubular member with respect to the frame. This adjustment, in a preferred arrangement, is achieved by loosening clamping means securing the flange to the front wall of the frame, and then rotating the flange to a different position before re-clamping it.

In a preferred arrangement, the front end of the drum can be connected to the front end of the shaft in different angular positions to enable the timing of the flutes of the drum (e.g., with reference to the flutes of another drum) to be adjusted. This adjustment and the adjustment of the valve can be, and preferably are, both made from the front of the machine.

An example of apparatus according to this invention is shown in the accompanying drawing which is a longitudinal section through one fluted drum.

As shown in the drawing, the machine includes a frame having front and rear walls 10 and 11 which define between them a suction manifold 12. This manifold may extend behind a number of drums all of which may be basically as shown in the drawing.

A drum 13 having flutes 14 is carried adjacent to the front wall 10 by a tubular member 15. This member 15 extends through the front wall 10 and has its left-hand end 15A engaging in an aperture in the rear wall 11. A sleeve valve 16 surrounds part of the tubular member and is formed with circumferentially extending slots 16A through which suction is transmitted to ports 13A in the drum to hold cigarettes 17 in the flutes of the drum where necessary. The sleeve valve 16 is secured to the tubular member 15 by releasable fastenings 18 at the outer end of the member 15.

A flange 15B on the tubular member 15 engages the front wall 10 of the frame and is secured to the front wall by a number of bolts 19 which pass through arcuate slots in the flange. Angular adjustment of the position of the valve sleeve is achieved by slackening the bolts 19 and then rotating an adjusting member 20 having an eccentric pin 20A which engages in a radial groove 21 in the frame.

A drive shaft 22 passes through the tubular member 15, being rotatably supported by bearings 23 and 24 in the member 15. At its left-hand end, the shaft 22 carries a gear 25 by which it is driven. At its right-hand end it is connected to the drum 13 via a key or spline 26, an end disc 27 and a number of circumferentially spaced bolts 28. The bolts 28 pass through arcuate slots in the end disc 27; thus, once they have been slackened, the drum 13 can be rotated slightly with respect to the drive shaft 22. When they are tightened, the bolts 28, which also pass through a clamping ring 29, clamp the disc 27 to the drum 13.

It will be appreciated that adjustment of the valve sleeve (by means of the adjusting member 20) and adjustment of the drum can both be achieved from the front of the machine.

The drum 13 is rotatably mounted around the tubular member 15, being supported at its outer end by the bearing 24 and at its inner end by a bearing 30 lying between the drum and the tubular member.

Suction is transmitted to the slots 16A in the sleeve valve via a recess 15C in part of the tubular member 15, and a passage 15D lying within the thickness of the wall of the tubular member in the region where that member passes through the front wall 10 of the frame. Thus the suction passages are completely isolated from the bearings 23, 24 and 30 and from the gear 25.

At a circumferential position at which the rods are required to be transferred from the drum (in this example, at the bottom of the drum), or at a position beyond the transfer position, compressed air is fed to the ports 13A in the drum via an axially extending groove 16B in the valve sleeve, a radial passage 31 extending through the valve sleeve and tubular member, an axially extending passage 32 defined partly by an insert 33 secured in the tubular member, and a radial passage 34 extending to a pipe 35 connected to a source of compressed air. The compressed air is intended to blow out any debris from the ports 13A; to assist in that action, the groove 16B may be inclined so as to communicate with only one port 13A at a time.

The drum can be readily removed after unscrewing a knob 36 which secures the disc 27 to the shaft 22; for that purpose, the left-hand end of the drum is a sliding fit over the bearing 30. After removal of the drum, the valve sleeve 16 can be readily removed by undoing the fastenings 18.

We claim:

1. Apparatus for conveying cigarettes by means of one or more fluted drums comprising a frame including spaced front and back walls defining between them a suction manifold; a fluted drum disposed in front of the frame and having ports in communication with the flutes thereof; a tubular drum-carrying member which extends through an opening in the front wall of the frame, engages and seals in or around an aperture in the rear wall of the frame, and has a flange by which it is secured to the front wall of the frame, the fluted drum being positioned for rotation around the tubular member; and a drive shaft which extends axially through the tubular member, is secured to the front end of the drum, is supported by bearings carried by the tubular member, and carries at its rear end behind the rear wall of the frame a gear or other means by which it is driven; said tubular member being provided with a passage within the thickness of the wall of the tubular member in the region where it extends through the front wall of the frame, so that suction may be transmitted to the ports of the flutes of the drum from the manifold via said passage.

2. Apparatus according to claim 1, in which the tubular member includes or carries around it, within the drum, a sleeve valve through which suction is transmitted to the ports in the flutes of the drum, and including means for adjusting the angular position of the tubular member with respect to the frame so as to adjust the timing of the application of suction to the flutes of said drum.

3. Apparatus according to claim 2, said adjusting means including releasable clamping means securing the flange to the front wall of the frame, the angular position of the tubular member being adjustable after release of the clamping means.

4. Apparatus according to claim 3, said adjusting means including an adjusting member rotatably mounted in the flange and having an eccentric pin engaging in a substantially radial groove in the front wall of the frame.

5. Apparatus according to claim 1, 2 or 3 including means for releasably connecting the front end of the shaft to the front end of the drum, thereby allowing the drum to be angularly adjusted relative to the shaft.

6. Apparatus according to claim 5 in which the front end of the shaft is secured to the front end of the drum via an end disk which is non-rotatably secured to the shaft and is adjustably secured to the drum by means of bolts passing through arcuate slots in the end disk.

7. Apparatus according to claim 2 including means defining generally an axially extending groove in the outer surface of the sleeve valve, at or near a position at which the cigarettes are to be transferred from the drum, said axially extending groove being arranged to communicate with ports opening into the flutes of the drum and with a source of compressed air for blowing air through the ports.

8. Apparatus according to claim 7 in which said axially extending groove is inclined to the axis of the drum so as to communicate with the ports successively.

* * * * *